US006244889B1

(12) United States Patent
James

(10) Patent No.: US 6,244,889 B1
(45) **Date of Patent: *Jun. 12, 2001**

(54) METHOD AND APPARATUS FOR AN ELECTROMECHANICALLY CONTROLLED ELECTRONIC INTERFACE PLUG

(75) Inventor: Gregory Alan James, San Jose, CA (US)

(73) Assignee: Intel Corporation, Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,570

(22) Filed: Jan. 20, 1998

(51) Int. Cl.[7] ..... H01R 13/627
(52) U.S. Cl. ..... 439/352; 439/258
(58) Field of Search ..... 439/953, 345, 439/352, 353, 354, 488, 489, 490, 154, 161, 258, 357–8, 372

(56) References Cited

U.S. PATENT DOCUMENTS 4,012,097 * 3/1977 Long et al. ..... 439/352
4,279,458 * 7/1981 Knapp ..... 439/258
4,433,889 * 2/1984 Ratchford et al. ..... 439/258
4,743,079 * 5/1988 Bloch ..... 439/161
4,821,147 * 4/1989 Jacobs et al. ..... 361/388
5,154,629 * 10/1992 Carver et al. ..... 439/352
5,197,900 * 3/1993 Ellis et al. ..... 439/352
5,201,669 * 4/1993 Lin ..... 439/357
5,641,299 * 6/1997 Meguro et al. ..... 439/347
5,683,264 * 11/1997 Hobgood et al. ..... 439/352
5,791,930 * 8/1998 Tabata et al. ..... 439/345
5,831,820 * 11/1998 Huang ..... 361/684

* cited by examiner

*Primary Examiner*—Lincoln Donovan
(74) *Attorney, Agent, or Firm*—Blakely, Sokoloff, Taylor & Zafman LLP

(57) ABSTRACT

A method and apparatus for an electromechanically controlled electronic interface plug. The interface plug provides electrical connection with a complementary connector while providing electromechanical control over the ability to disconnect or decouple the interface plug. When the prevention mechanism is in an engaged position it prevents decoupling the interface plug. When the prevention mechanism is in a disengaged position it allows decoupling the interface plug. An electrical signal controls whether the prevention mechanism moves from the engaged to the disengaged position. An electronic controller provides the electrical signal when it is determined safe to allow the interface plug to decouple. The electromechanical interface plug is especially useful in notebook computer docking/undocking applications where the notebook computer must be in a safe state before undocking can occur.

5 Claims, 5 Drawing Sheets

METHOD AND APPARATUS FOR AN ELECTROMECHANICALLY CONTROLLED ELECTRONIC INTERFACE PLUG

BACKGROUND OF THE INVENTION

1. Field of the Invention

The present invention relates generally to electrical connectors, and more specifically to electromechanically controlled electronic interface plugs, for use in computer systems, to allow disconnection after the computer system is ready.

2. Related Art

Various types of mechanical interface connectors are used to electrically connect computer system components. For example, male and female pin type connectors are commonly used to provide electrical connection between the motherboard and video monitors and printers. FIG. 1A illustrates one type of female connector 17 and corresponding male connector 18 where the pins (dark circles, top view) of the male connector 18 couple by sliding inside the hollow cylinders (hollow circles, top view) of the female connector 17.

Various mechanisms are used to "dock" and "undock" (i.e., electrically connect and disconnect, respectively) notebook computers to other external devices, such as video displays, printers, and external hard drives, to extend the capabilities of the notebook. However, for safe operation notebook computers should only be docked and undocked when the notebook computer is in a safe docking or undocking state, respectively. Current notebook computer docking systems use a "VCR" (video cassette recorder) type docking/undocking mechanism in which a software-controlled motorized apparatus built into the docking station engages and disengages (i.e., docks and undocks) the notebook to the docking station connector in a manner similar to the automatic insertion and ejection of a VHS tape in a VCR. The VCR type docking mechanism is used to prevent undocking before the system is ready. For example, the docking station may be programmed to not activate the VCR undocking mechanism until the notebook computer indicates it is in a safe undocking state.

FIG. 1B illustrates a mechanical interface plug 16 that is plugged/unplugged (i.e., connected/disconnected or coupled/uncoupled) solely under mechanical control. The plug 16 is not suitable for providing a computer docking connection because the release buttons 12 and 14 can be pushed at any time to allow the hooks 2 and 4 to be disengaged from the corresponding hooks 1 and 3 of complementary plug 15. Therefore, a user could easily undock a notebook computer even when the notebook is not ready for undocking.

Known docking/undocking solutions have disadvantages. VCR type docking stations are unreliable and expensive, often adding hundreds of dollars to the cost of a notebook computing platform. Mechanical interface plugs are inexpensive, but they do not prevent a user from undocking the notebook computer before it is ready.

Therefore, a method and apparatus for an electromechanically controlled electronic interface plug is needed.

SUMMARY OF THE INVENTION

The present invention is a method and apparatus for an electromechanically controlled electronic interface plug. In one embodiment the interface plug includes an electrical connector, a prevention mechanism, and an electrical signal.

The electrical connector provides the electrical coupling for the interface plug. When the prevention mechanism is in an engaged position it prevents decoupling the interface plug. When the prevention mechanism is in a disengaged position it allows decoupling the interface plug. The electrical signal controls whether the prevention mechanism moves from the engaged to the disengaged position.

BRIEF DESCRIPTION OF THE DRAWINGS

The present invention is illustrated by way of example and not limitation in the figures of the accompanying drawings, in which like references indicate similar elements.

DETAILED DESCRIPTION OF THE PRESENT INVENTION

A method and apparatus for an electromechanically controlled electronic interface plug is described. In the following description, numerous specific details, such as spring and wire arrangements, hook shapes, connector types, etc., are set forth in order to provide a thorough understanding of the present invention. It will be apparent, however, to one skilled in the art that the present invention may be practiced without these specific details. In other instances, well-known methods, circuits and mechanical designs are shown in block diagram form in order not to obscure the present invention.

As discussed in the background, VCR type docking/undocking stations are unreliable and expensive. Mechanical interface plugs do not prevent a user from undocking the notebook computer before it is ready.

Figure 1A:
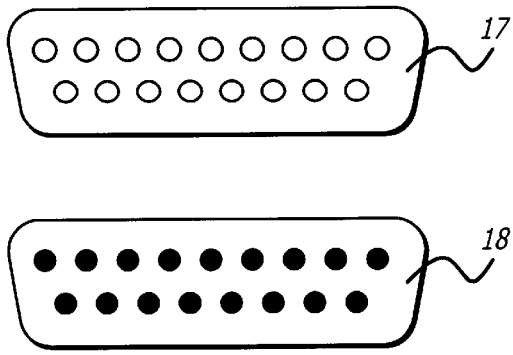
FIG. 1A (Prior Art)
FIG. 1A illustrates typical male/female connectors used to connect computers to peripheral devices.
Figure 2A:
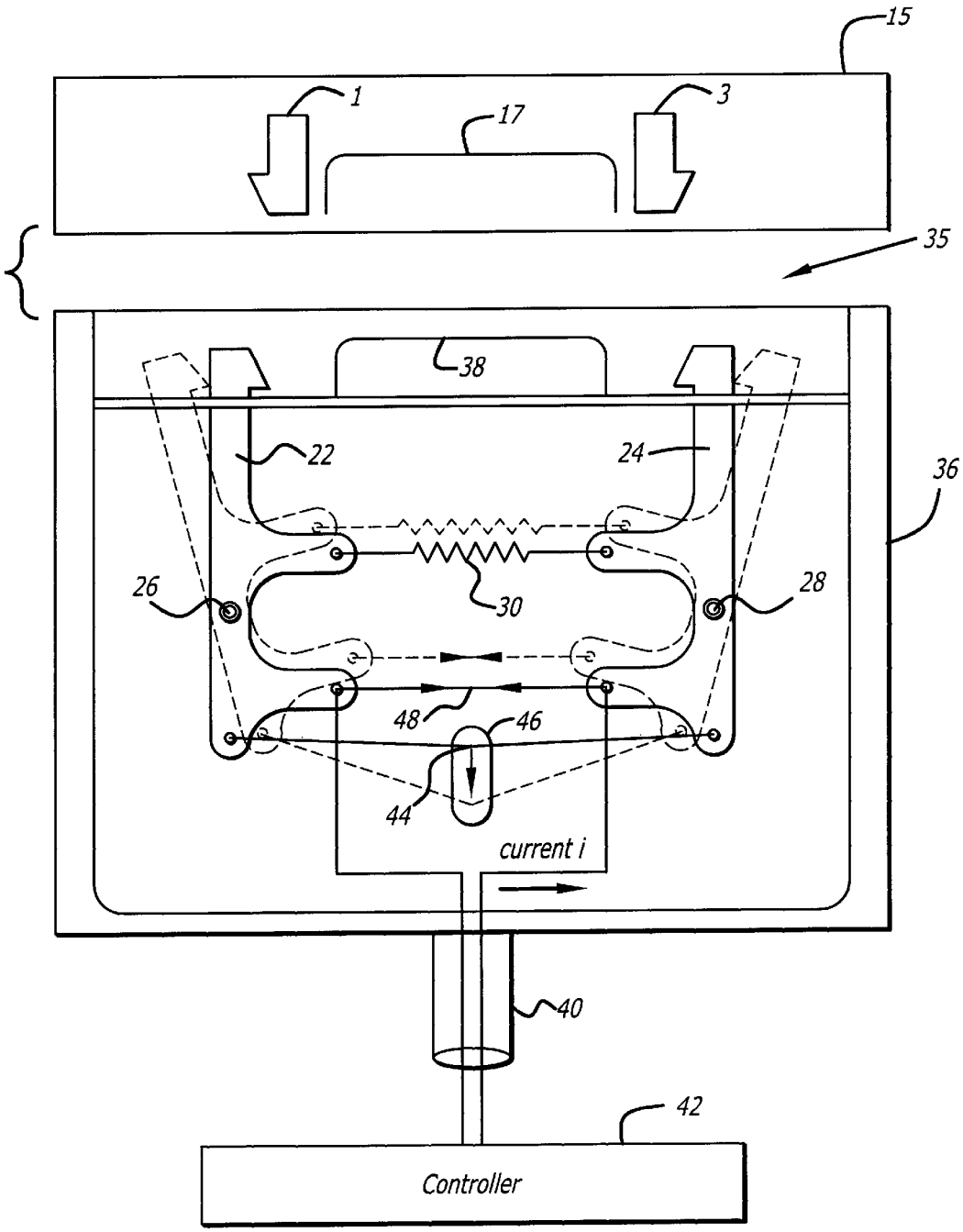
FIG. 2A illustrates one embodiment of the present invention electromechanically controlled electronic interface plug.

FIG. 2A illustrates one embodiment of the present invention electromechanically controlled electronic interface plug 35. A connector 38 provides electrical connection for the wires in cable 40. The connector 38 may be various types of known electrical connectors (such as female or male connectors 17 and 18 of FIG. 1A).

Figure 1B:
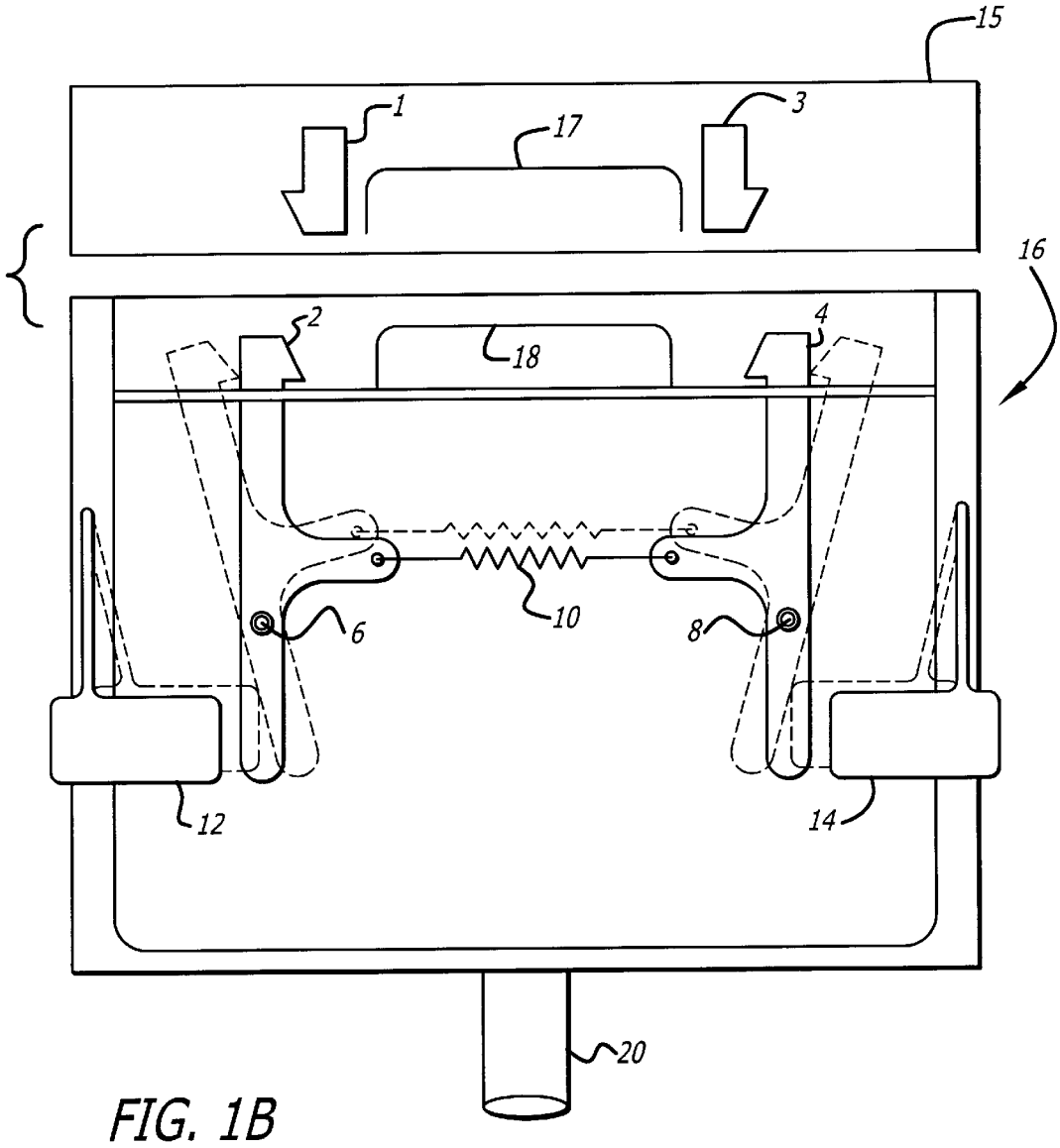
FIG. 1B illustrates a mechanical interface plug.

Hook members 22 and 24 are coupled to rotate around pivot pins 26 and 28, which are coupled to a plug case, or housing, 36. A spring 30 is coupled to pull hooks 22 and 24 into an "engaged" position (shown by the solid lines). In the engaged position hooks 22 and 24 are positioned to latch with complementary hook members (such as 1 and 3 of FIG. 1B) to prevent the plug 35 from being decoupled (i.e., unplugged, disconnected, or undocked) from a complementary plug (such as plug 15 of FIG. 1B).

A "muscle wire" 48 is coupled to pull the hooks 22 and 24 into a "disengaged" position (shown by the dotted lines)

in response to an electrical current. When the hooks 22 and 24 are in the disengaged position, a user can decouple plug 35 from the complementary plug by simply pulling the plugs apart. The muscle wire 48 is made of a type of wire that contracts when an electrical current passes through it.

A controller 42 determines when it is safe for the user to decouple plug 35 and then provides the electrical current that causes the muscle wire 48 to contract, pulling the hooks 22 and 24 into the disengaged position. This electromechanical control over decoupling makes the plug 35 useful for notebook docking solutions since notebook users can be prevented from undocking the notebook except when the controller 42 determines that undocking is safe.

Figure 2B:
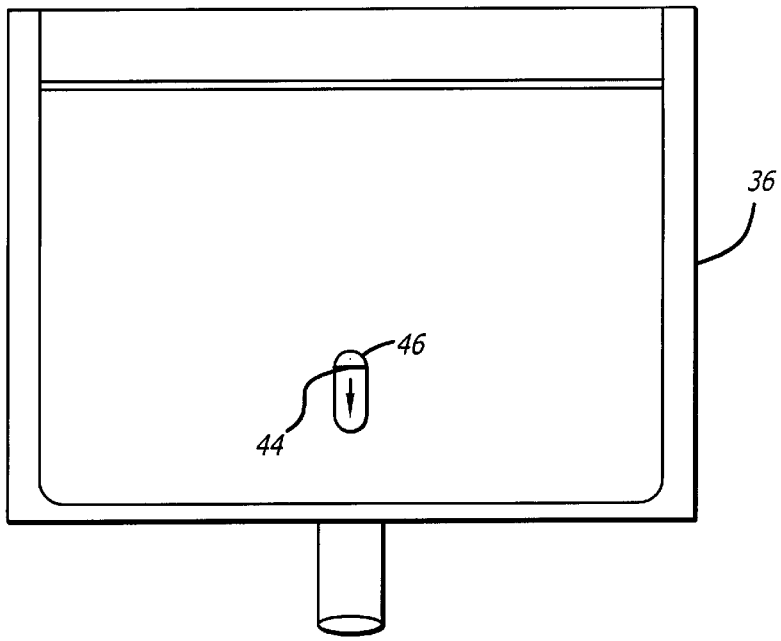
FIG. 2B illustrates the override slot 46 in the plug case 36 for the embodiment of FIG. 2A.

To address the possibility of software, or other system failures that would prevent the controller 42 from sending the appropriate release signal, the plug 35 also includes an override release bar 44. When an override of the electromechanical release mechanism is necessary, the user simply inserts an appropriate object into the override slot 46 and pulls the override release bar 44 in the downward direction of the arrow, thereby causing the hooks 22 and 24 to disengage. The user can then decouple, or undock, the plug 35. FIG. 2B illustrates the override slot 46 in the plug case 36.

Note that the muscle wire 48 and spring 30 allow the hooks to "open" when a user connects the plug 35 to the connector 15. After connection, the spring 30 pulls the hooks 22 and 24 into the engaged position to latch them with the corresponding hooks 1 and 3 of the connector 15.

Figure 3B:
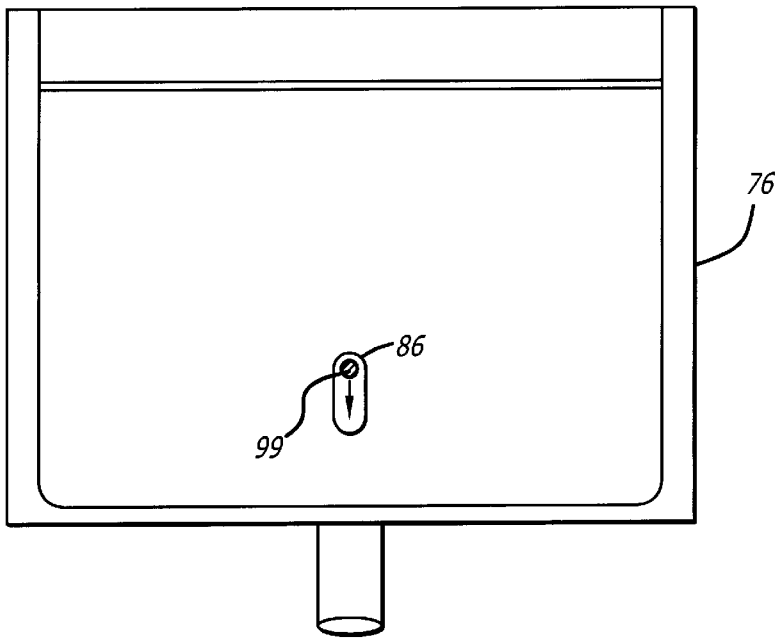
FIG. 3B illustrates the override slot 86 in the plug case 76 for the embodiment of FIG. 3A.
Figure 3A:
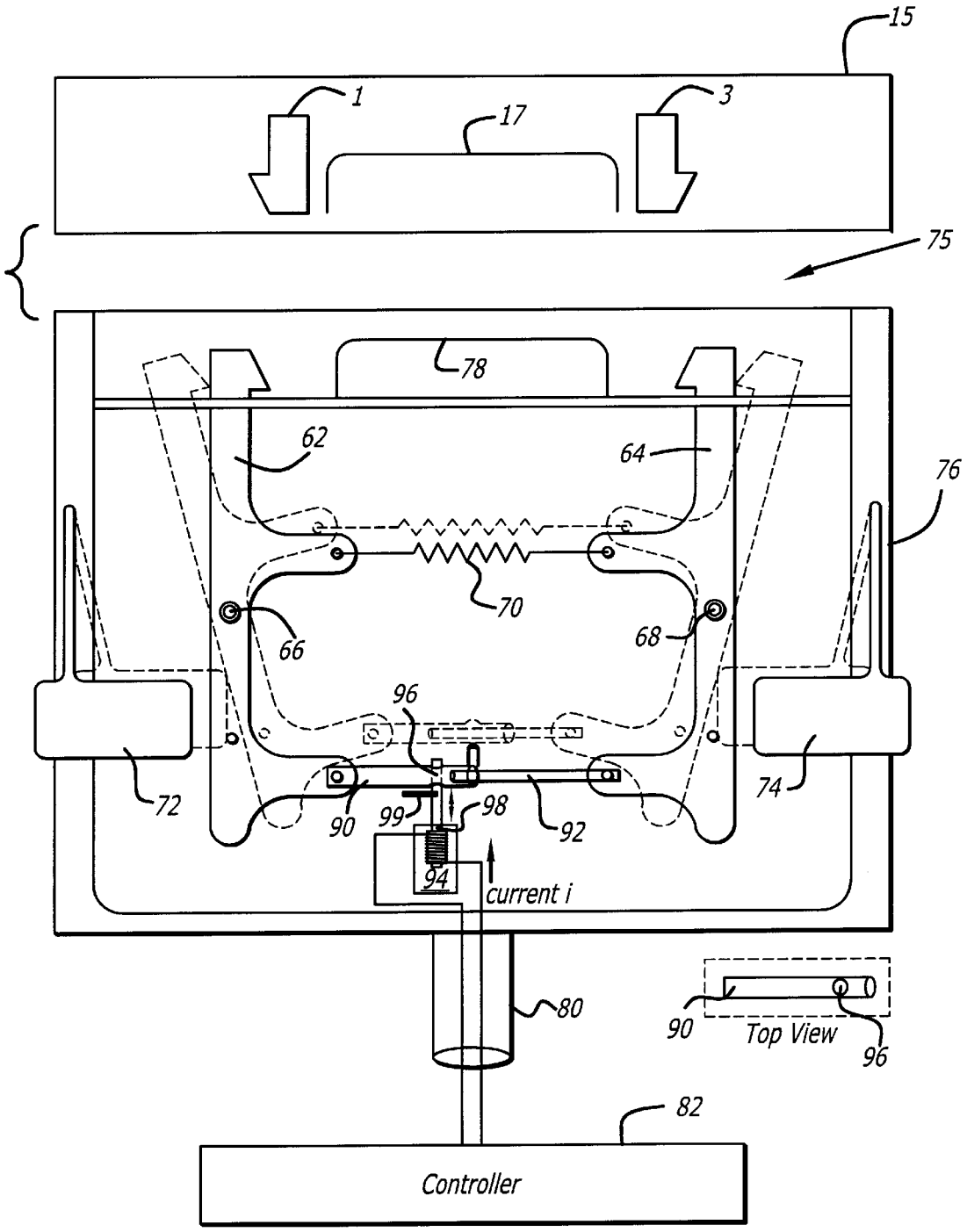
FIG. 3A illustrates another embodiment of the present invention electromechanically controlled electronic interface plug.

FIG. 3A illustrates another embodiment of the present invention electromechanically controlled electronic interface plug. Similar to the embodiment of FIG. 2A, a connector 78 provides electrical connection for the wires in cable 80. Hook members 62 and 64 are coupled to rotate around pivot pins 66 and 68, which are coupled to a plug case, or housing 76. A spring 70 is coupled to pull hooks 62 and 64 into the engaged position to prevent the plug 75 from being disconnected or undocked.

The embodiment of FIG. 3A uses a different mechanism to control the movement of the hooks 62 and 64 to the disengaged position. In a "blocking" position, a solenoid bar 98 (e.g., a stop pin) is positioned perpendicularly through a hole passing through an outer tube 90 in order to block an inner bar 92 from sliding inside the outer tube 90. Thus, in the blocking position, the solenoid bar 98 prevents the hooks 62 and 64 from being moved from the engaged position to the disengaged position.

In a "non-blocking" position, the solenoid bar 98 is retracted from the outer tube 90, allowing the inner bar 92 to slide inside the outer tube 90. Thus, when the solenoid bar 98 is in the non-blocking position, a user can press the release buttons 72 and 74 to cause the hooks 62 and 64 to move to the disengaged position.

A solenoid 94 moves the solenoid bar 98 to the blocking and non-blocking positions in response to an electrical current.

Similar to FIG. 2A, a controller 82 determines when it is safe for the user to decouple, or undock, plug 75 and provides the appropriate electrical current to control the solenoid 94.

The embodiment of FIG. 3A also provides an override release capability to allow for undocking in case of a system failure. An override release bar 99 is coupled to the solenoid bar 98 to allow a user to manually move the solenoid bar 98 to the non-blocking position. FIG. 3B illustrates an override slot 86 in the plug case 76 through which the user can access the override release bar 98.

During connection of the plug 75 to the connector 15, the plug 75 can allow latching or mating of the hooks 62 and 64 with hooks 1 and 3 in at least two ways. First, the controller 82 can understand a "need to connect" request and cause the solenoid bar to move to the disengaged position, thereby allowing the hooks 62 and 64 to "open" and latch with the corresponding hooks 1 and 3 of connector 15. Second, the hooks 62 and 64 can be made of a flexible material that allows them to bend open to latch with the corresponding hooks 1 and 3. The second approach does not require the controller 82 to understand when the plug 75 is being connected or docked.

The electromechanical interface plugs of the present invention are useful for notebook docking solutions since notebook users can be prevented from undocking the notebook except when the notebook is in a safe undocking state.

Figure 4:
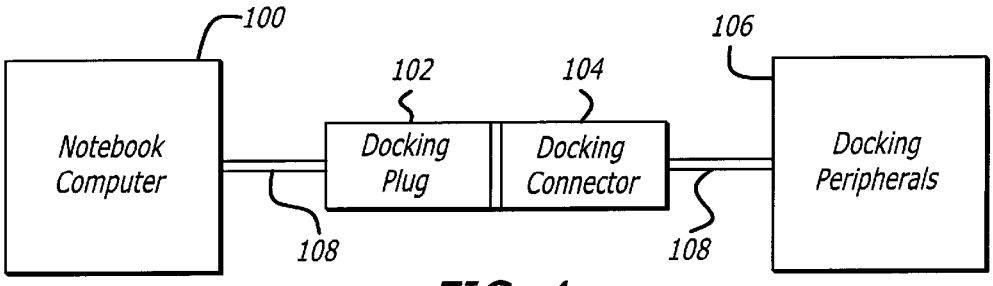
FIG. 4 illustrates one embodiment of the present invention in a notebook computer docking system.

FIG. 4 illustrates one embodiment of the present invention interface plug as used in a notebook computer docking system. The notebook computer 100 is designed for easy transport such that its user can carry it to meetings, etc. However, sometimes it is desirable to dock, or connect, the notebook computer 100 to other devices. For example, a businessman may carry his notebook computer with them to meetings, when traveling, etc., but want to dock his notebook to a larger desktop VGA screen, a desktop printer, or other computer peripheral devices.

The present invention electromechanically controlled interface plug can be used in the docking plug 102 to provide inexpensive, reliable docking with the docking peripherals while preventing the user from undocking the notebook before it is in a safe undocking state. Alternatively the present invention interface plug can be included in the docking connector 104. The cables 108 provide the wires for electrical connection. Of course, the docking plug 102 and/or docking connector 104 can be integrated into the notebook 100 and/or docking peripheral 106.

Figure 5:
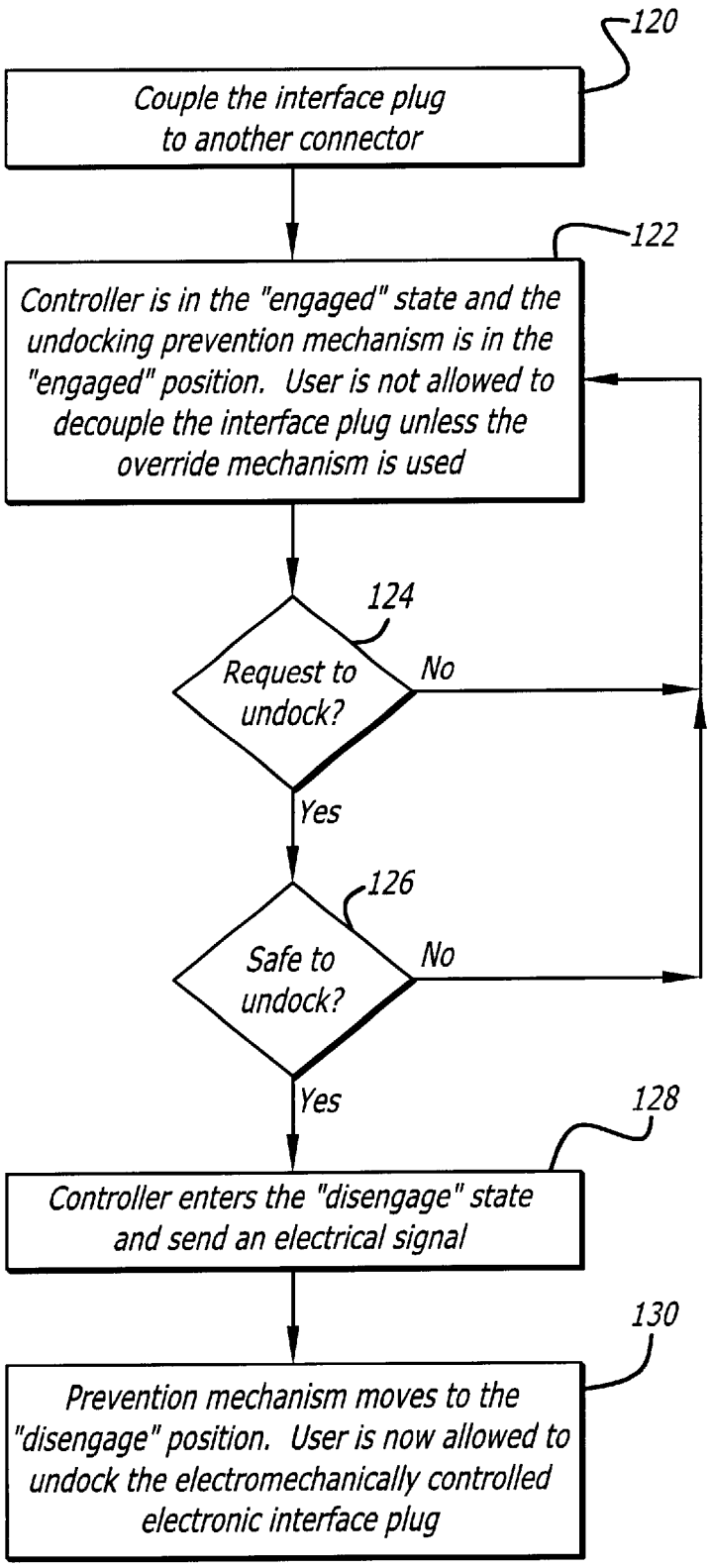
FIG. 5 illustrates one embodiment of the present invention method for operating the electromechanically controlled electronic interface plug of the present invention.

FIG. 5 illustrates one embodiment of the present invention method for operating the present invention electromechanically controlled electronic interface plug. The interface plug may be, but is not required to be, coupled to another connector (step 120).

The undocking prevention mechanism of the interface plug includes a hook, or other suitable latching mechanism, that is normally in an engaged position to prevent decoupling of the plug (step 122). In this state a user cannot disconnect the plug from the other connector (if connected) unless the override release mechanism is used.

The controller detects whether there has been a request to undock or disconnect (step 124). When a request to undock is detected, the controller determines whether the notebook computer is in a state that is safe for undocking (step 126).

If the notebook computer is ready to undock, the controller sends an electrical signal causing the undocking prevention mechanism to move to the disengage position (steps 128 and 130). In this position, the prevention mechanism allows the user to undock the computer by disconnecting the interface plug (if connected).

Thus, a method and apparatus for an electromechanically controlled electronic interface plug has been described.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. An interface plug comprising:

a hook member movably coupled to a support member;

a spring, coupled to the hook member, to pull the hook member into an engaged position;

a release button, coupled to the support member, to allow a user to move the hook member into a disengaged position; and a stop pin, coupled to the hook member, that moves between a blocking position and a non-blocking position in response to an electrical current, when in the blocking position the stop pin prevents the hook member from moving to the disengaged position, when in the non-blocking position the stop pin allows the hook member to move to the disengaged position.

2. The interface plug of claim 1 further comprising:

a solenoid coupled to move the stop pin into the blocking and non-blocking positions in response to the electrical current; and a controller, coupled to the solenoid, to provide the electrical current to the solenoid to allow selective disengagement of the interface plug.

3. The interface plug of claim 1 further comprising an override release mechanism, coupled to the stop pin, to allow an external force to move the stop pin into the non-blocking position.

4. The interface plug of claim 3 further comprising a housing member coupled to substantially enclose the interface plug, wherein the housing member has an override release opening to allow human access to the override release mechanism.

5. A method for operating an electromechanical interface plug comprising:

placing a prevention mechanism of the interface plug in an engaged position to prevent decoupling the interface plug;

providing an electrical signal indicating when it is safe to decouple the interface plug; and in response to the electrical signal, placing the prevention mechanism of the interface plug in a disengaged position to allow decoupling the interface plug.

* * * * *